US005751210A

United States Patent [19]

Kosich

[11] Patent Number: 5,751,210

[45] Date of Patent: May 12, 1998

[54] SYNCHRONIZED VIDEO/AUDIO ALARM SYSTEM

[75] Inventor: Joseph Kosich, South Toms River, N.J.

[73] Assignee: Wheelock Inc., Long Branch, N.J.

[21] Appl. No.: 807,063

[22] Filed: Feb. 27, 1997

Related U.S. Application Data

[62] Division of Ser. No. 407,282, Mar. 20, 1995, Pat. No. 5,608,375.

[51] Int. Cl.[6] ..... G08B 25/00

[52] U.S. Cl. ..... 340/293; 340/326

[58] Field of Search ..... 340/293, 326, 340/286.05, 331, 518; 315/241 S, 200 A; 307/35

[56] References Cited

U.S. PATENT DOCUMENTS

| | | | |
|---|---|---|---|
| 3,488,558 | 1/1970 | Grafton . | |
| 3,881,130 | 4/1975 | Stiller . | |
| 3,969,720 | 7/1976 | Nishino . | |
| 3,973,168 | 8/1976 | Kearsley . | |
| 4,068,149 | 1/1978 | Wuchnich . | |
| 4,101,880 | 7/1978 | Haus . | |
| 4,162,489 | 7/1979 | Thilo et al. . | |
| 4,216,413 | 8/1980 | Plas . | |
| 4,389,632 | 6/1983 | Seidler . | |
| 4,449,073 | 5/1984 | Mongoven et al. . | |
| 4,471,232 | 9/1984 | Peddie et al. . | |
| 4,472,714 | 9/1984 | Johnson . | |
| 4,899,131 | 2/1990 | Wilk et al. . | |
| 4,924,149 | 5/1990 | Nishida et al. . | |
| 4,952,906 | 8/1990 | Buyak et al. . | |
| 5,121,033 | 6/1992 | Kosich | 315/241 R |
| 5,128,591 | 7/1992 | Bocan . | |
| 5,342,069 | 8/1994 | Kosich et al. . | |
| 5,400,009 | 3/1995 | Kosich et al. | 340/331 |
| 5,598,139 | 1/1997 | Karim et al. | 340/286.11 |
| 5,608,375 | 3/1997 | Kosich | 340/293 |

FOREIGN PATENT DOCUMENTS

| | | |
|---|---|---|
| 0102229 | 3/1984 | European Pat. Off. . |
| 2031200 | 4/1980 | United Kingdom . |
| 2103404 | 2/1983 | United Kingdom . |
| 2211329 | 6/1989 | United Kingdom . |

OTHER PUBLICATIONS

Wheelock Inc. Catalog, Series 30 Horns & Series 7000 Strobe Horns, 1992.

Wheelock Inc., Product Brochure, MT Series, 1993.

*Primary Examiner*—Jeffery A. Hofsass
*Assistant Examiner*—John Tweel, Jr.
*Attorney, Agent, or Firm*—Baker & Botts, L.L.P

[57] ABSTRACT

An audio/visual alarm system which includes multiple microprocessor-controlled alarm units connected in a common loop to a fire alarm control panel and an interface control circuit. The interface control circuit causes brief interruptions in power to the alarm units which synchronize operation of the alarm units and which can also be used as alarm control signals. The interface control circuit allows for control of both audio and visual alarms using only the single common loop connection between alarm units.

11 Claims, 11 Drawing Sheets

SYNCHRONIZED VIDEO/AUDIO ALARM SYSTEM

This is a divisional of application Ser. No. 08/407,282 filed on Mar. 20, 1995, now U.S. Pat. No. 5,608,375.

BACKGROUND OF THE INVENTION

This invention relates to circuits for electronic alarm systems such as are used to provide visual and audio warning in electronic fire alarm devices and other emergency warning devices and, more particularly, to a control circuit which enables the system to provide both a visual and an audio alarm signal, including a silence feature, while using only one signal wire loop.

Strobe lights and/or audio horns are used to provide warning of potential hazards or to draw attention to an event or activity. An important field of use for these signalling devices is in electronic fire alarm systems. Strobe alarm circuits typically include a flashtube and a trigger circuit for initiating firing of the flashtube, with energy for the flash typically supplied from a capacitor connected in shunt with the flashtube. In some known systems, the flash occurs when the voltage across the flash unit (i.e., the flashtube and associated trigger circuit) exceeds the threshold voltage required to actuate the trigger circuit, and in others the flash is triggered by a timing circuit. After the flashtube is triggered, it becomes conductive and rapidly discharges the stored energy from the shunt capacitor until the voltage across the flashtube has decreased to a value at which the flashtube is extinguished and becomes non-conductive.

In a typical alarm system, a loop of several flash units is connected to a fire alarm control panel which includes a power supply for supplying power to all flash units in the loop when an alarm condition is present. Each unit typically fires independently of the others at a rate determined by its respective charging and triggering circuits. Underwriters Laboratories specifications require the flash rate of such visual signalling devices to be between 20 and 120 flashes per minute.

In addition to having a strobe alarm as described above, it may also be desirable to have an audio alarm signal to provide an additional means for alerting persons who may be in danger. In such systems, a "silence" feature is often available whereby, after a period of time has elapsed from the initial alarm, the audio signal may be silenced either automatically or manually. Heretofore, in a system where alarm units having both a visual alarm signal and an audio alarm signal have been implemented, two control loops, one for video and one for audio, have been required between the fire alarm control panel and the series of alarm units.

In a system as described above, the supply voltage may be 12 volts or 20–31 volts, and may be either D.C. supplied by a battery or a full-wave rectified voltage. Underwriters Laboratories specifications require that operation of the device must continue when the supply voltage drops to as much as 80% of nominal value and also when it rises to 110% of nominal value. However, when the voltage source is at 80% of nominal value, the strobe may lose some intensity which could prove crucial during a fire emergency.

It is a primary object of the present invention to provide a control circuit which will enable an alarm system to provide both audio and visual synchronized alarm signals using only a single control signal wire loop between the alarm units, while allowing for the capability of silencing the audio alarm.

It is yet another object of the present invention to provide the ability to lower the flash frequency when a low input voltage is detected, thereby ensuring a proper flash brightness.

It is another object of the present invention to provide an alarm interface circuit which will enable an existing alarm system to sound a Code 3 alarm whether or not the existing alarm system is already equipped with Code 3 capability.

It is another object of the present invention to provide a circuit having these properties and which will also work with: (a) both D.C. and full-wave rectified supplies; (b) all fire alarm control panels; and (c) mixed alarm units (i.e., 110 candela and 15 candela with and without audio signals).

SUMMARY OF THE INVENTION

In accordance with the present invention, an alarm system is provided which includes a control circuit that allows multiple audio/visual alarm circuits, connected together by a single two-wire control loop, to be synchronously activated when an alarm condition is present. The control circuit also allows for other alarm control functions, such as the deactivation of the audio alarm, to be carried out using only the single control loop. The control circuit is able to provide these functions by interrupting power to the alarm units for approximately 10 to 30 milliseconds at a time. Preferably, each alarm unit is equipped with a microcontroller which is programmed to interpret the brief power interrupt, or "drop out", as either a synchronization signal or a function control signal, depending on the timing of the drop out. The microcontroller can also be programmed to interpret different sequences of drop outs as control signals for other functions such as reactivation of the audio alarm.

The alarm unit is capable of detecting a low input voltage. When the detected voltage drops below a predetermined threshold, the alarm unit will lower the frequency of the visual alarm signal, preferably a strobe, to ensure that the strobe flashtube receives enough energy to flash at an adequate brightness.

The alarm unit is also capable of functioning independently of any synchronization signal from the control circuit. In the event a synchronization signal is not received, an internal timer will cause the flashtube to flash at a predetermined rate.

BRIEF DESCRIPTION OF THE DRAWINGS

Other objects, features and advantages of the invention will become apparent, and its construction and operations better understood, from the following detailed description when read in conjunction with the accompanying drawings, in which.

DESCRIPTION OF THE PREFERRED EMBODIMENT

Figure 1:
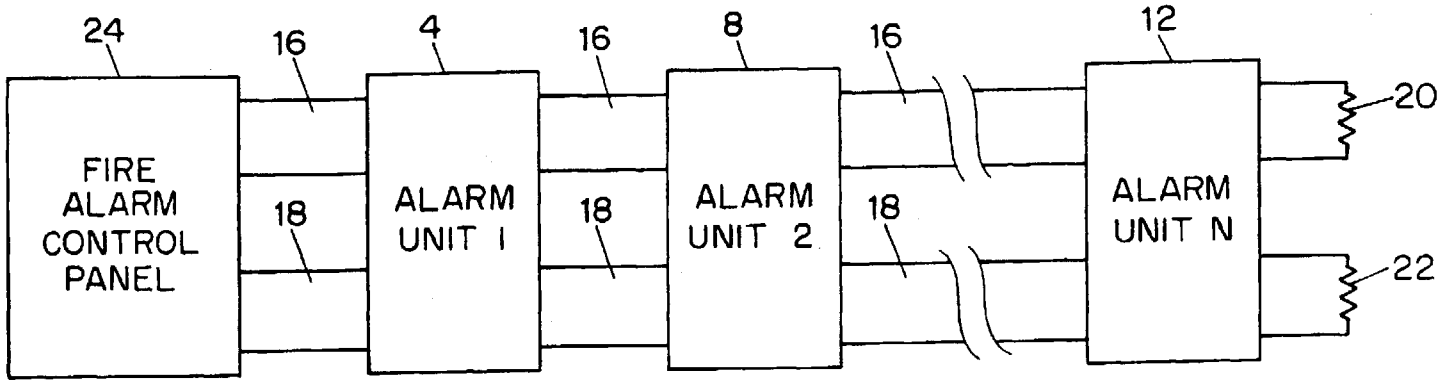
FIG. 1 (PRIOR ART)
FIG. 1 is a block diagram of a conventional prior art alarm system which provides for both visual and audio alarm signals.

In the conventional prior art alarm system shown in FIG. 1, which provides for both visual and audio alarm signals, multiple alarm units 4, 8 and 12, numbered 1 through N, are connected by two common loops 16, 18 having the usual end of the line resistors 20, 22, respectively. The alarm units have both audio and visual signalling capabilities. The first control loop 16 handles visual control signals being output from the fire alarm control panel 24 to the alarm units, and the second control loop 18 handles audio control signals being output from the fire alarm control panel 24 to the alarm units.

Figure 2:
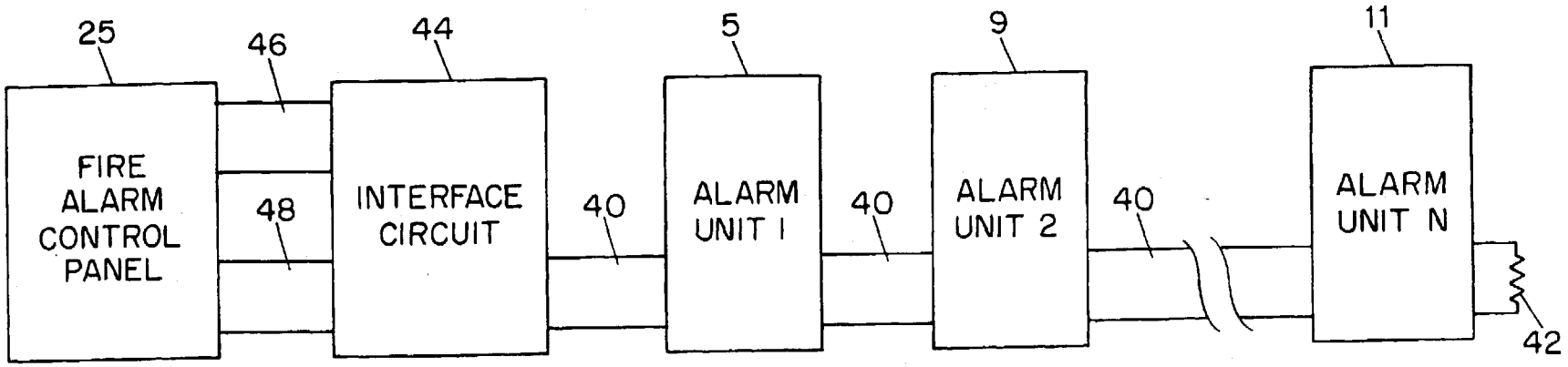
FIG. 2 is a block diagram of one embodiment of an alarm system of the present invention.

FIG. 2 is a block diagram of an embodiment of the alarm system of the present invention. By contrast to FIG. 1, multiple alarm circuits 5, 9 and 11, numbered 1 to N, are connected in a single control loop 40 with the usual end of the line resistor 42. In accordance with the invention, all units are caused to flash and sound synchronously using an interface control circuit 44 and the single control loop 40. The interface control circuit 44 is connected to the fire alarm control panel 25 via a primary input loop 46 and a secondary input loop 48. The alarm control panel 25 and the interface control circuit 44 can either be two separate devices or built into one unit.

The interface control circuit 44 provides the capability of silencing the audio alarms by outputting a signal to the alarm circuits 1 through N on the common loop 40 when a "silence" control signal is received from the fire alarm control panel 24 via the secondary input loop 48. According to the present invention, a single power interruption or "drop out", of approximately 10 to 30 msec in duration, is used as the synchronization, or "sync", pulse to keep the alarm units in sync with one another. A "silence" control signal is communicated to each of the alarm circuits by a second "drop out" in very close proximity to the sync pulse. As will be discussed in greater detail hereinbelow, it is possible to use the "drop outs" to signal any one of a number of functions to the alarm units, "silence" being just one.

There are an infinite number of possible audio sounds and signalling schemes which may be employed in an alarm system. Actual or simulated bells, horns, chimes and slow whoops, as well as prerecorded voice messages, can all be used as audio alarm signals. One audio signalling scheme gaining popularity is the evacuation signal found in National Fire Protection Agency 72. The signal is also known as Code 3. A Code 3 signal consists of three half-second horn blasts separated by half-second intervals of silence followed by one and one-half seconds of silence. Some alarm systems currently in use are equipped with Code 3 capability. For such systems, the present invention may be implemented using the secondary input loop 48 to transmit a Code 3 signal from the existing fire alarm control panel 24 to the interface control circuit 44 which will, in turn, send out a Code 3 signal to the alarm units. If the fire alarm system is one which is not equipped with Code 3 capability, the interface control circuit 44 can provide the signal itself. For purposes of illustration, but not limitation, the Code 3 signal will be discussed hereinbelow as the signalling scheme of the present invention.

Turning now to the visual alarm, for purposes of illustration, the strobe flashrate discussed herein is approximately 1.02 Hz under normal conditions. As will be explained in detail later, at an input voltage below the product specifications, the flashrate may be lowered to 0.5 Hz. Underwriters Laboratories permits a flashrate as low as 0.33 Hz.

Figure 3:
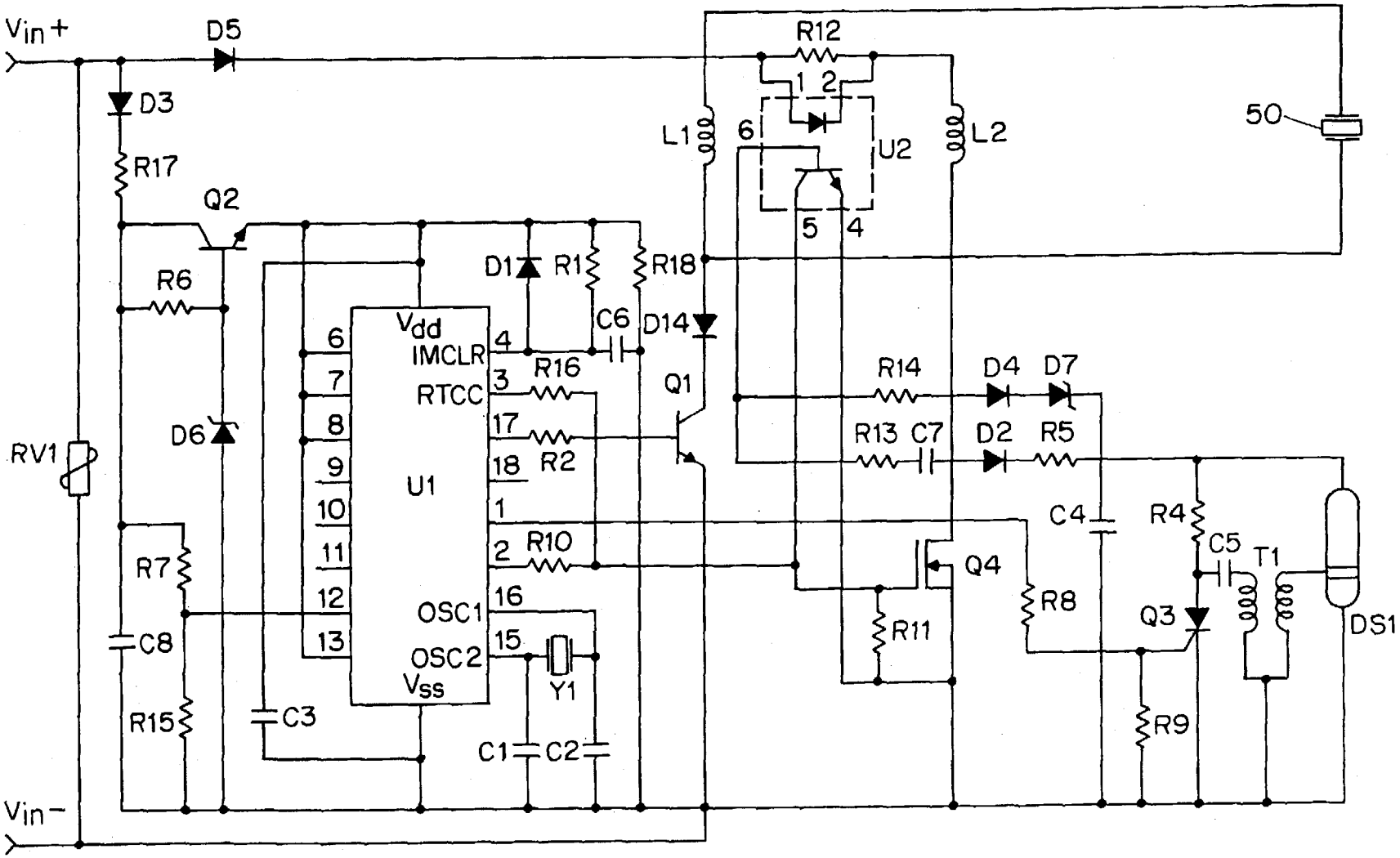
FIG. 3 is a circuit diagram of one embodiment of an alarm unit employed in the present invention.

FIG. 3 is a circuit diagram of one embodiment of each of the alarm units 5, 9 and 11. The unit depicted is a microprocessor-controlled audio/visual alarm unit which serves to demonstrate the full range of features available in the present invention. One skilled in the art will appreciate that an alarm unit with only visual or only audio capabilities may also be integrated into the system where desired. Each unit is energized from a D.C. power source embodied in the control panel 25. Metal Oxide Varistor RV1 is connected across the D.C. input to protect against transients on the input. A voltage regulator circuit provides the necessary voltage drop to power the microcontroller U1. Resistors R6 and R17 are connected in series between the cathode of diode D3 and the base electrode of switch Q2, which in this case is a transistor, and also to the cathode of Zener diode D6 which provides 5.00 volts ±5% volts to the microcontroller U1 across terminals $V_{dd}$ and $V_{ss}$. A capacitor C3 connected across the $V_{dd}$ and $V_{ss}$ terminals of U1 acts as a filter and will hold the voltage across U1 during the power drop outs which are used in the system as control signals.

A reset circuit for the microcontroller U1 includes a diode D1 and a capacitor C6 connected in series with the emitter electrode of switch Q2 and in parallel with a resistor R18, and a resistor R1 connected in parallel with diode D1. The junction between diode D1 and capacitor C6 is connected to the "CLEAR" terminal 4 of microcontroller U1. Oscillations at a frequency of 4 MHz are applied to terminals OSC1 and OSC2 of the microcontroller by a resonator circuit consisting of an oscillator Y1 and a pair of capacitors C1 and C2 connected between the negative side of the voltage source and the first and second oscillator inputs, respectively.

Resistors R7 and R15 and capacitor C8 provide a means at microcontroller input terminal 12 for detecting gaps or drop outs in input power which indicate the presence of either a full wave rectified (FWR) input voltage or a sync or control pulse from the interface module 44.

In the alarm circuit of FIG. 3, the flash circuit portion utilizes an opto-oscillator for D.C.-to-D.C. conversion of the input voltage to a voltage sufficient to fire the flashtube. In the opto-oscillator, a capacitor C4 connected in parallel with the flashtube DS1 is incrementally charged, through a diode D2 and a resistor R5, from an inductor L2, which is cyclically connected and disconnected across the D.C. supply. At the beginning of a connect/disconnect cycle, the light emitting diode (LED) and transistor of an optocoupler U2 are both off and switch Q4 is on, completing a connection between inductor L2 and the D.C. power source. As the current flow through L2 increases with time, the LED of U2 energizes and turns on the optically coupled transistor of U2 which in turn shuts off switch Q4, thereby disconnecting L2 from the D.C. source. During the off period of switch Q4, energy stored in inductor L2 is transferred through diode D2 and resistor R5 to capacitor C4. Capacitor C7 and resistor R13 are connected in series between diode D2 and the base of the transistor of optocoupler U2. When inductor L2 has discharged its stored energy into capacitor C4, the LED of U2 ceases to emit light and the transistor of U2 turns off. This in turn causes Q4 to turn on, thereby beginning the connect/disconnect cycle again.

The on and off switching of Q4, and, therefore, the rate at which the increments of energy are transferred from inductor L1 to capacitor C1, is determined by the switching characteristics of optocoupler U2, the values of resistors R10, R11, R12, the value of inductor L2 and the voltage of the D.C. source, and may be designed to cycle at a frequency in the range from about 3000 Hz to 30,000 Hz. The repetitive opening and closing of switch Q4 eventually charges capacitor C4 to the point at which the voltage across it attains a threshold value required to fire the flashtube DS1. Overcharging of capacitor C4 is prevented by a resistor R14 and Zener diodes D4 and D7 connected in series between the base electrode of the optocoupler transistor and the positive electrode of storage capacitor C4. The values of these components are chosen so that when the voltage across capacitor C4 attains the firing threshold voltage of the flashtube DS1, a positive potential is applied to the base electrode of the optocoupler transistor and turns on the transistor which, in turn, turns off switch Q4 and disconnects inductor L2 from across the D.C. source.

In addition to the opto-oscillator, the flash circuit includes a circuit for triggering flashtube DS1. The trigger circuit includes a resistor R4 connected in series to the combination of a switch Q3, which in this embodiment is an SCR, connected in parallel with the series combination of a capacitor C5 and the primary winding of an autotransformer T1. The secondary winding of the autotransformer T1 is connected to the trigger band of the flashtube DS1. When switch Q3 is turned on, capacitor C4 discharges through the primary winding of transformer T1 and induces a high voltage in the secondary winding which, if the voltage on capacitor C4 equals the threshold firing of the tube, causes the flashtube DS1 to conduct and quickly discharge capacitor C4. Q3 is turned on from microcontroller output pin 1 and through a voltage divider composed of resistors R8 and R9.

The alarm unit depicted in FIG. 3 also includes an audio alarm circuit, comprised of resistor R2, transistor switch Q1, diode D14, inductor L1 and piezoelectric element 50 connected as shown. In the alarm unit shown, both the audio and visual alarm signals are controlled by the microcontroller U1, the audio signal being operated via output terminal 17 and the visual signal being triggered via output terminal 1. However, one skilled in the art will appreciate that a timer circuit means, such as disclosed in the copending, commonly-owned U.S. patent application No. 08/133,519, the pertinent contents of which are hereby incorporated by reference, can be employed to cause the strobe to flash independently of the microcontroller in the event of a malfunction which causes a failure of the microcontroller U3 in control unit 44 to send a sync signal.

By way of example, the circuit shown in FIG. 3, when using a 24 volt D.C. power source, may use the following parameters to obtain the above-described switching cycle:

| ELEMENT | VALUE OR NUMBER |
|---|---|
| C1, C2 | CAP., 33pF, |
| C3 | CAP., 68μF, 6V |
| C4 | CAP., 68μF, 250V |
| C5 | CAP., 047μF, 400V |
| C6 | CAP., .47μF |
| C7 | CAP., .33pF, 250V |
| C8 | CAP., .01μF, |
| D1 | DIODE 1N914 |
| D2, D14 | DIODE HER106 |
| D3 | DIODE 1N4007 |
| D4, D7 | DIODE 1N5273B |
| D5 | DIODE 1N4007 |
| D6 | DIODE 1N4626 |
| DS1 | FLASHTUBE |
| L1 | INDUCTOR, 47mH |
| L2 | INDUCTOR, 2.2mH |
| Q1 | TRANSISTOR, ZTX455 |
| Q2 | TRANSISTOR, 2N5550 |
| Q3 | SCR, EC103D |

-continued

| ELEMENT | VALUE OR NUMBER |
|---|---|
| Q4 | TRANSISTOR, IRF710 |
| R1 | RES., 39K |
| R2 | RES., 560 |
| R4 | RES., 220K |
| R5 | RES., 180, ½W |
| R6 | RES., 4.7K |
| R7 | RES., 10K, 1% |
| R8 | RES., 1K |
| R9 | RES., 10K, 1% |
| R10 | RES., 1K |
| R11 | RES., 1M |
| R12 | RES., 5.36 OHMS, 1% |
| R13 | RES., 100K |
| R14 | RES., 33K |
| R15 | RES., 2.21K, 1% |
| R16 | RES., 10K |
| R17 | RES., 330, ½W |
| R18 | RES., 10K |
| T1 | TRIGGER TRANSFORMER |
| U1 | MICROCONTROLLER, PIC16C54 |
| U2 | OPTOCOUPLER, 4N35 |
| Y1 | CERAMIC RES., 4MHZ |

As mentioned hereinabove, the microcontroller U1 of the alarm unit is responsible for activating and deactivating the audio horn alarm in a desired sequence, detecting FWR or D.C. voltage and adapting the visual strobe alarm to a low input voltage by lowering the flashrate. The flowcharts of FIGS. 4 and 4A–4E illustrate the software routines of the microcontroller of the alarm unit shown in FIG. 3.

Figure 4:
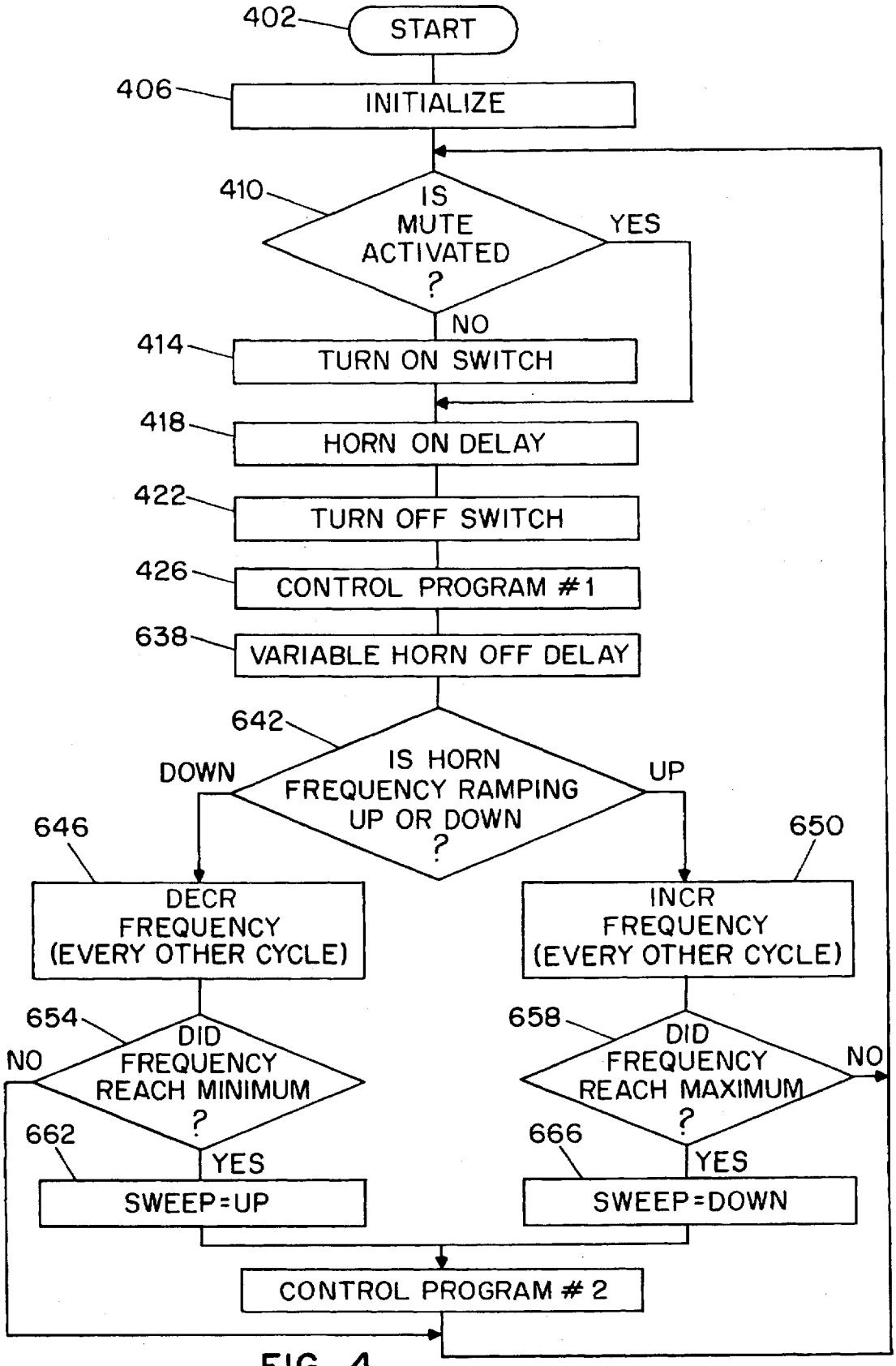
FIG. 4 illustrates the software routine of the main program.

FIG. 4 depicts the Main Program of the alarm unit microcontroller. This portion is responsible for the horn alarm and is executed at the desired center frequency for the horn, here approximately 3,500 Hz.

The program begins and is initialized at blocks 402 and 406. At block 410, an inquiry is made as to whether the horn is currently being muted, as will be the case if the Code 3 signal is in one of the half-second or one and one-half second silence periods or if the "SILENCE" feature has been activated. If the "MUTE" function is not activated, the microcontroller U1 will turn on the horn at block 414 by sending out a high signal from microcontroller terminal 17 to turn on switch Q1. In the preferred embodiment of the present invention, the horn is programmed to have a varying frequency, here between 3,200 and 3,800 Hz, to better simulate an actual horn, and will ramp up and down between the set minimum and maximum frequencies. In this embodiment, the "HORN ON DELAY" time, at block 418 is constant and is chosen to be approximately 0.120 msec. The varying of the horn frequency is accomplished by ramping the "HORN OFF DELAY" time up and down. Following the "HORN ON DELAY", the horn is turned off at block 422 by turning off switch Q1.

Figure 4A:
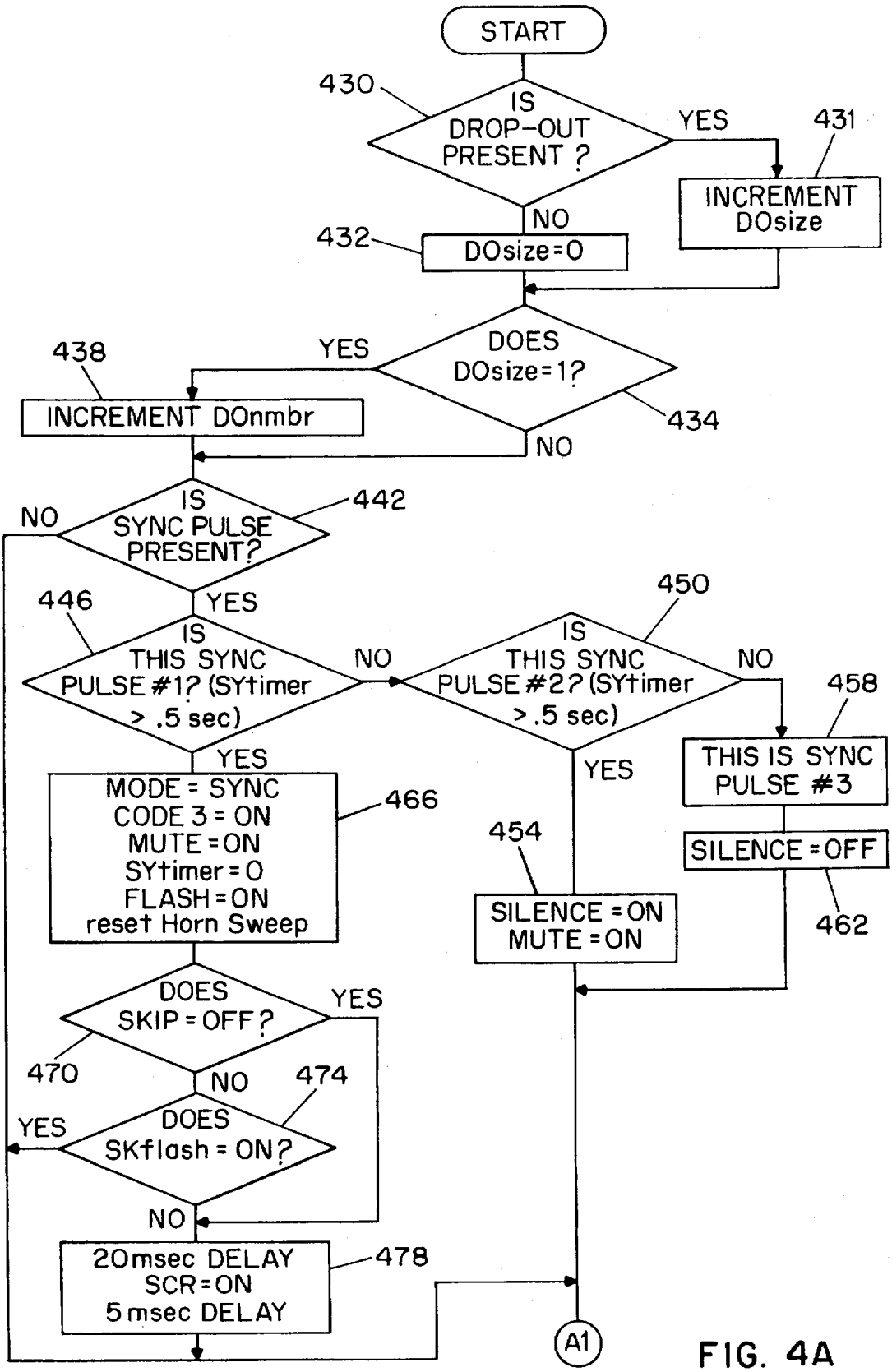
FIGS. 4A and 4B illustrate the software routine of Control Program No. 1.
Figure 4B:
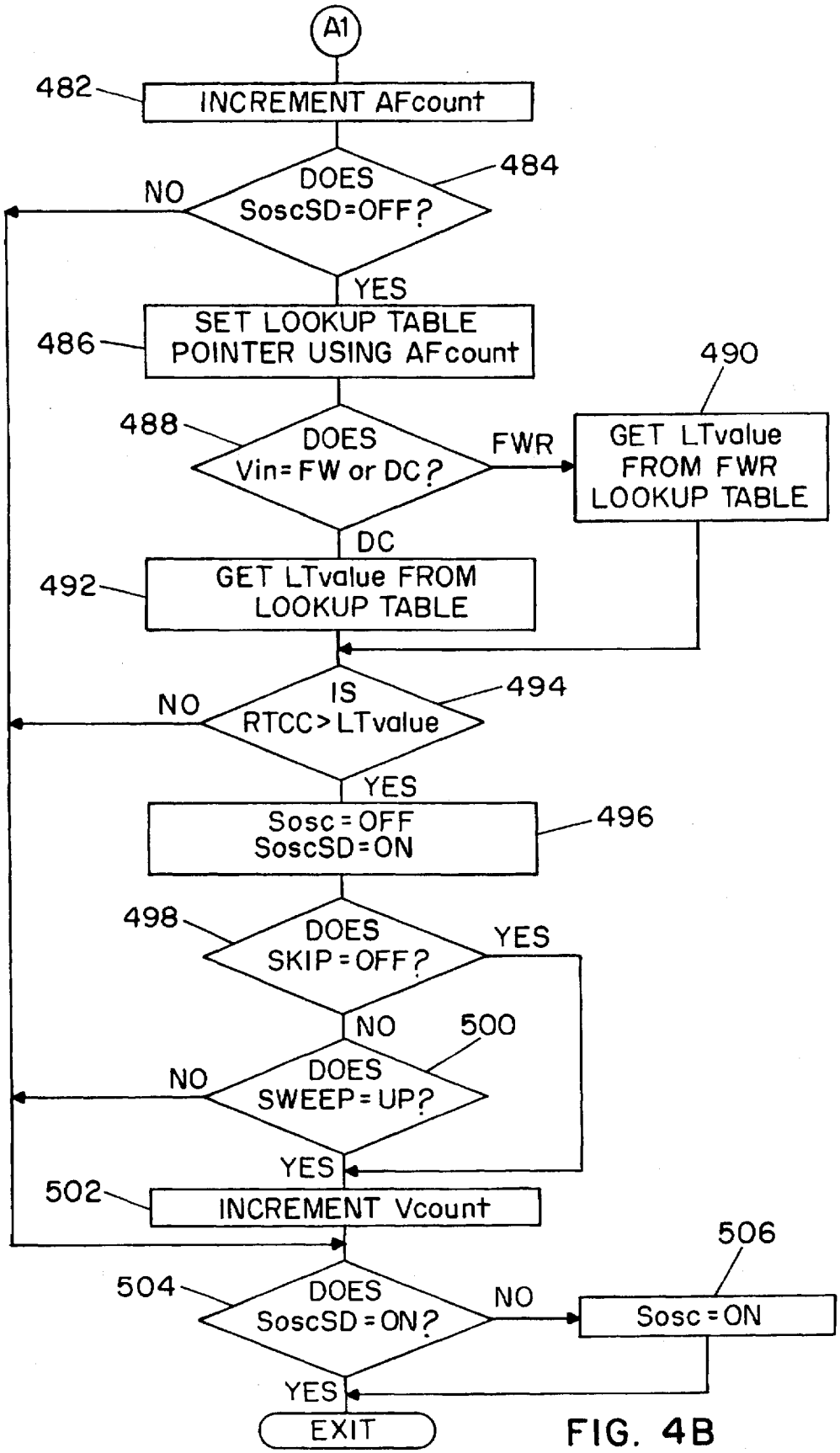

At block 426, Control Program No. 1 is run. Control Program No. 1 is responsible for detection and interpretation of the voltage dropouts, which serve as sync or control pulses (hereinafter "sync/control pulses") to the units, and is represented in flow-chart form in FIGS. 4A and 4B. FIGS. 4A and 4B will be discussed in detail hereinbelow following the discussion of FIG. 4.

After leaving Control Program No. 1, the main program, at block 638, will begin the "HORN OFF DELAY". As mentioned above, the "HORN OFF DELAY" time will be varied to better simulate an actual horn sound. At block 642, the program will check to see whether the delay is currently being ramped up or down, and, in either of block 646 or 650, will continue the ramping in the current direction on every other Main Program cycle. At either block 654 or 658, the program will loop back to block 410 to determine if the "MUTE" function has been activated if neither the minimum nor maximum specified horn frequency has been reached, in this example 3,200 and 3,800 Hz, respectively. If the minimum or maximum frequency has been reached, the ramp direction will be changed at block 662 or 666, after which the program will run Control Program No. 2, depicted in FIGS. 4C, 4D amd 4E.

Turning now to FIG. 4A and 4B, following the start of Control Program No. 1 the software looks for an input voltage drop out as indicated at block 430. Detection of a drop out indicates either a sync/control pulse or a FWR input voltage. Detection of the leading edge of a drop out initiates a counter "DOsize". If the drop out is present, "DOsize" is incremented at block 431. If no drop out is present, the counter is reset to zero at block 432. Drop outs are detected at microcontroller input terminal 12.

Next, at block 434, the program checks to see if this is the beginning of a drop out by inquiring as to whether "DOsize= 1." If so, the program at block 438 increments a counter, "DOnmbr", which keeps track of the number of dropouts. At block 442, the program checks for the presence of a sync/control pulse using the "DOsize" counter. If the drop out is wide enough, a sync/control pulse is present.

One skilled in the art will appreciate that multiple pulses can be used as control signals for the system. According to the present invention, in any such scheme, the first pulse will indicate the beginning of a new sync cycle. By way of example, here, the presence of a second pulse immediately following the first sync pulse will activate the "SILENCE" feature throughout the system and turn off any audio alarm which may be sounding. The presence of a pulse in the first and third pulse positions will deactivate the "SILENCE" feature causing the horns to sound when activated.

The software needed to perform these functions is illustrated in the flowchart of FIG. 4A following block 442. If a sync/control pulse is detected, the program at block 446 determines whether it is a sync pulse by checking the how much time has elapsed since the last pulse. If "SYtimer" indicates that it has been more than 0.5 seconds, then the pulse is the first of the cycle. If less than 0.1 seconds has elapsed, then the pulse is determined at block 450 to be in the second position and the "SILENCE" and "MUTE" features are activated at block 454. In this example, since only three pulse positions are being used, if "SYtimer" is any other value, then the pulse is determined at block 458 to be in the third position and the "SILENCE" feature is deactivated at block 462.

If the pulse is a sync pulse, block 466 sets several functions. "MODE" is set to "sync", "CODE 3" is turned on, "MUTE" is turned on, "SYtimer" is reset to zero, "FLASH" is turned on, and the horn frequency is returned to its starting position.

At block 470, the program checks to see if the "SKIP" function is off. The "SKIP" function and "SKflash" variable are used to cut the flashrate in half when the input voltage falls below an acceptable level, in this example 20V. When the "SKIP" function is activated, the variable "SKflash" will toggle between on and off once each flash cycle causing every other flash to be skipped. This is seen in the flowchart at block 474 where if "SKIP" is not off, the program checks to see whether "SKflash" is on, which it will be every other cycle. On the other hand, if "SKIP" is off at block 470, the program jumps to block 478 and flashes the strobe by delaying 20 msec, turning on SCR Q3 and delaying another 5 msec. If "SKpulse" is on at block 474, block 478 will be skipped and the strobe will not be flashed.

The next section of the program, beginning at block 482 in FIG. 4B, checks to see whether the capacitor is being charged high enough to sufficiently flash the flashtube DS1. At block 482, a variable "AFcount" is incremented. "AFcount" is used to count the number of cycles of Control Program No. 1 which corresponds to the audio frequency of the audio alarm signal.

At block 484, inquiry is made as to the status of a control variable "SoscSD", which is indicative of the "oscillator shut down" function. "SoscSD" being on indicates that the opto-oscillator is shut down. If "SoscSD" is off, the program continues with box 486 which sets a lookup table pointer based on "AFcount", i.e., based upon how many audio signal cycles have elapsed. The lookup table value, "LTvalue", is a predetermined minimum desirable number of cycle counts for the opto-oscillator and is used to determine whether capacitor C4, which provides the energy to flash flashtube DS1, is charging too quickly. First, however, at block 488, the program determines whether Vin is FWR or D.C. Depending on which one it is, the program will determine "LTvalue" using either a FWR lookup table at block 490 or a D.C. lookup table at block 492.

Next, at block 494, "LTvalue" is compared to the number of connect/disconnect cycles of the opto-oscillator responsible for charging C4. This is done by using the real time clock counter at microcontroller input pin RTCC and resistor R16 to keep count of the number of times the opto-oscillator has cycled. If the count is greater than "LTvalue", then the oscillator is turned off at block 496 by turning on "SoscSD" and turning off "Sosc".

At block 502, a variable "Vcount" is incremented. "Vcount" is used to determine whether the alarm unit is receiving a proper input voltage. Its significance will be discussed in greater detail shortly hereinbelow.

Returning briefly to block 484, if "SoscSD" is not off, that is, if the "oscillator shut down" function is on, then the program jumps to block 504 and will not increment "Vcount". As will be seen hereinbelow, once "SoscSD" is turned on, it will not be turned off again until Control Program No. 2 is executed. As discussed above with respect to the Alarm Unit Main Program, Control Program No. 2 is executed only at the top and bottom of the horn sweep cycles. The number of times this occurs can be controlled by the size of the step of the horn frequency increase or decrease. In the example under discussion, this will happen 120 times each second, one second being the approximate period between flashes. Therefore, the highest value which "Vcount" can attain between flashes is 120. This is also true when the "SKIP" function is activated and the flash period becomes two seconds, i.e., Control Program No. 2 is executed 240 times between flashes, since blocks 498 and 500 allow "Vcount" to be incremented only if either the "SKIP" function is off or both the "SKIP" function is on and the horn frequency is sweeping up.

Returning to block 494, if RTCC has not exceeded "LTvalue", the program jumps to block 504 and "Vcount" will not be incremented. At block 504, the program checks to see if the "oscillator shut down" function is on. If not, the oscillator is turned on at block 506 and the control program is exited. If "SoscSD" is on, the control program is exited without turning on "Sosc".

Figure 4C:
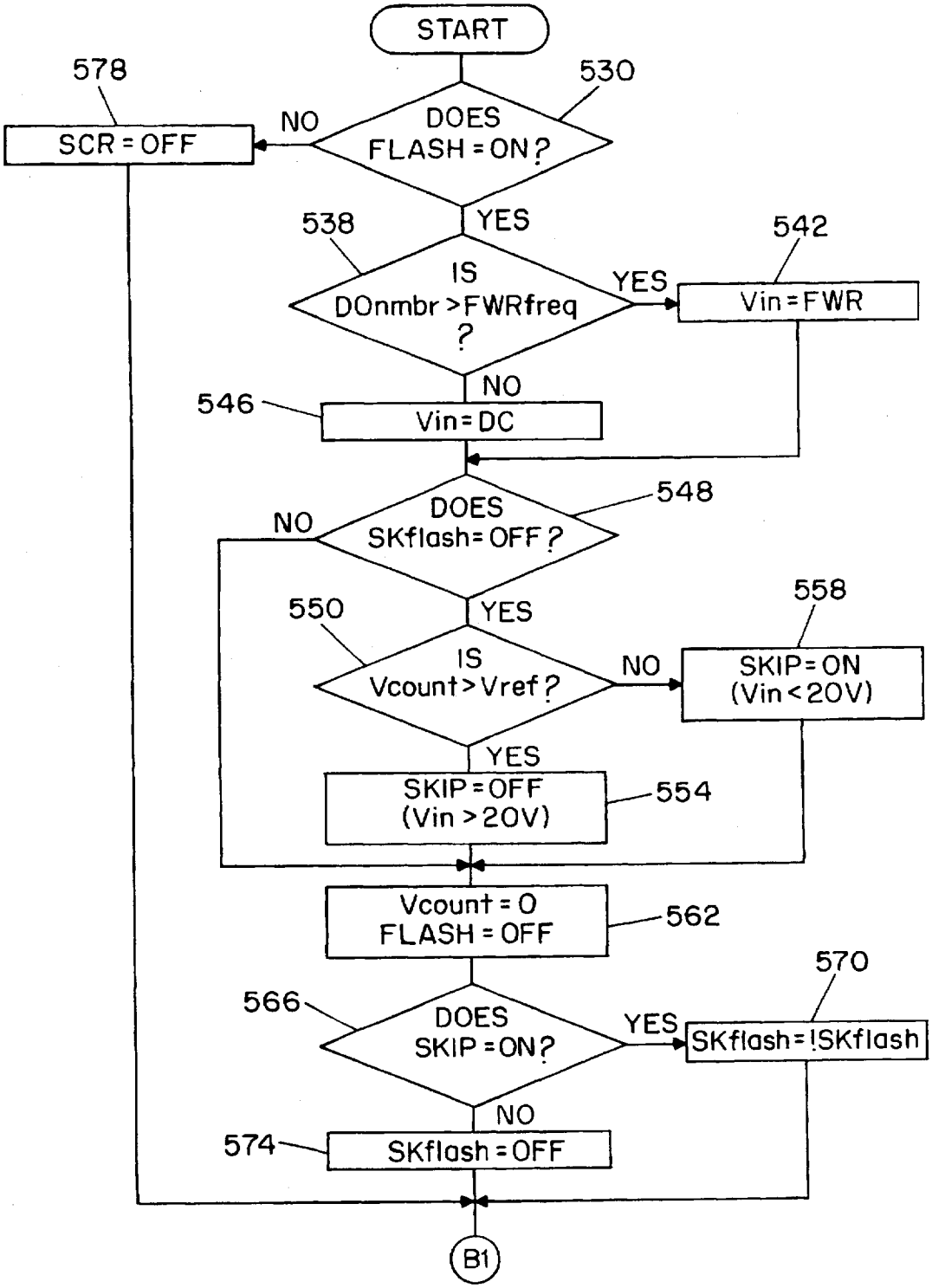
FIGS. 4C, 4D and 4E illustrate the software routine of Control Program No. 2.
Figure 4D:
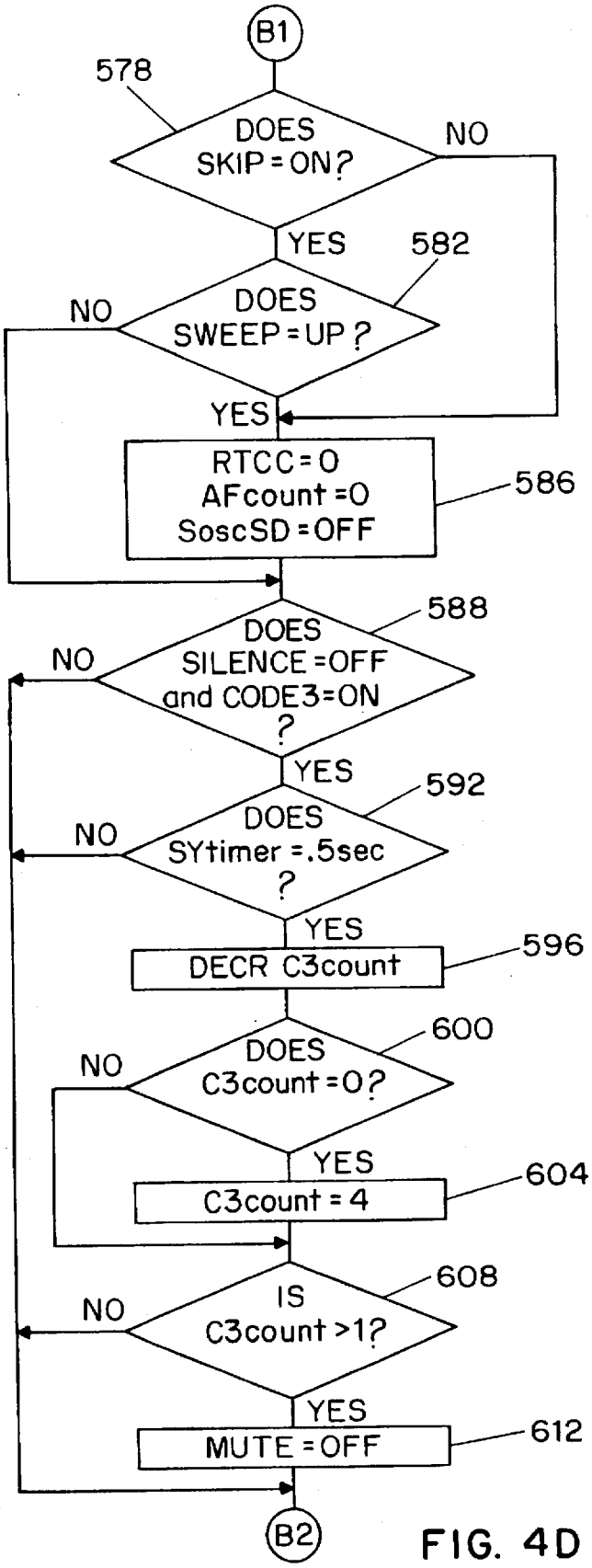
Figure 4E:
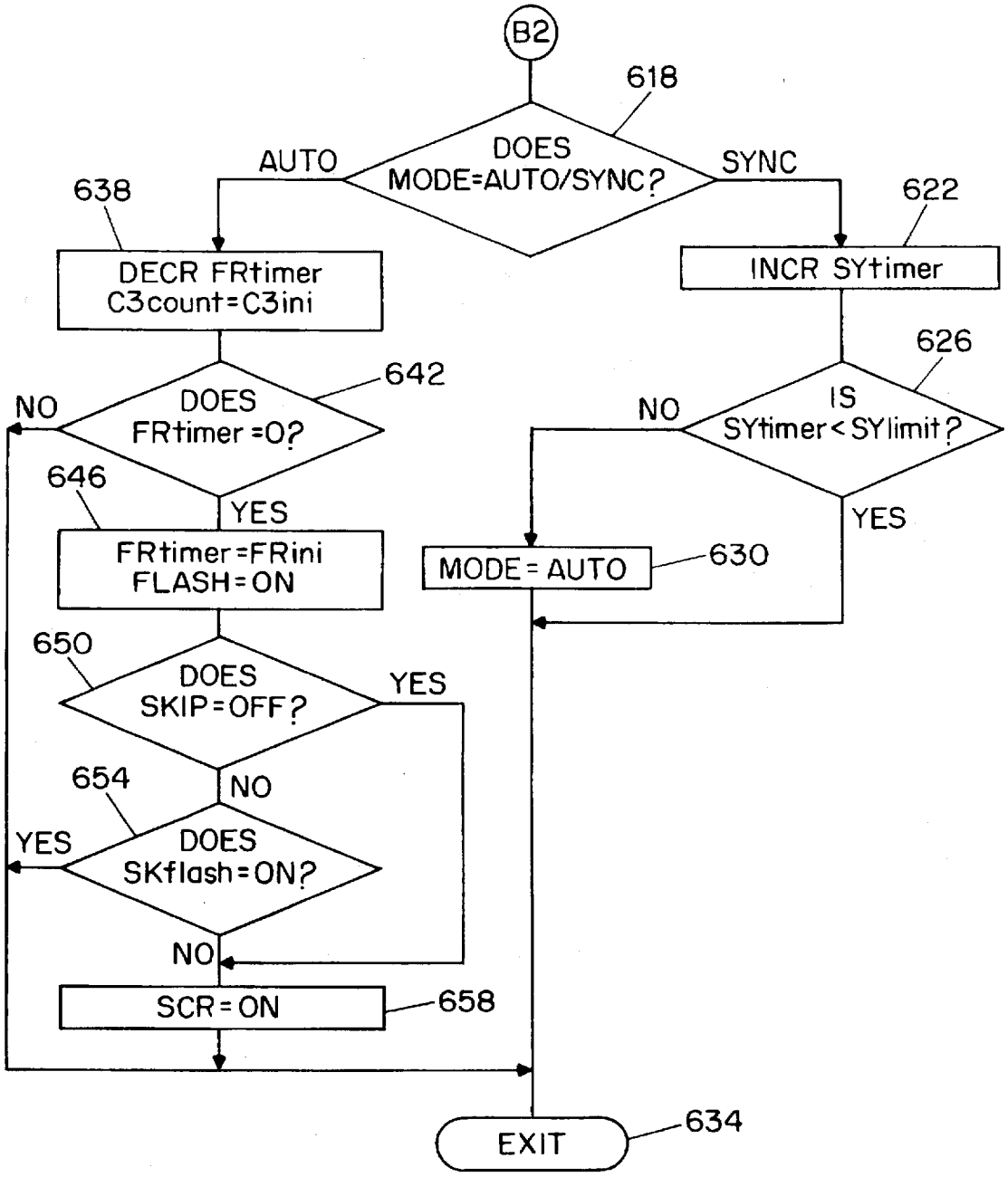

Now, turning to FIG. 4C, 4D and 4E, which represents the flowchart for Control Program No. 2, the program checks at block 530 to see if the "FLASH" function has been activated. If not, at block 578, SCR Q3 of the alarm unit is turned off via pin 1 of the microcontroller and the next several program functions relating to determination of the input voltage are passed over.

If the "FLASH" function is on, the program, at blocks 538, 542 and 546, checks to see whether the number of drop outs, represented by the variable "DOnmbr", indicates that a FWR input voltage is being used, and the variable "Vin" is set to the appropriate input voltage type, either FWR or D.C.

The next function carried out by the micro-controller software relates to the feature discussed briefly hereinabove whereby the alarm unit will compensate for a below-nominal input voltage by lowering the flash frequency. More particularly, when the input voltage is determined to be below 20 volts, the flash frequency will be cut in half to approximately 0.5 Hz, or one flash every two seconds. Determination of the input voltage is accomplished using the variable "Vcount" which, as previously discussed, under certain circumstances is incremented in Control Program No. 1 when the opto-oscillator has not been shut down and the real time clock counter as represented by variable "RTCC" has exceeded "LTvalue".

Before performing this function, however, the program at block 548 checks to see if "SKflash" is off. If not, then the voltage check is passed over and the program proceeds to block 562. If, on the other hand, the current flash is not being skipped, then at block 550 "Vcount" is compared to a predetermined constant, "Vref".

As discussed above, "Vcount" will never be incremented higher than 120 within the time period between flashes, and, if the input voltage is over 20 volts, "Vcount" should be incremented all the way to 120 during each flash cycle. If the input voltage is below 20 volts, "Vcount" should be zero. In the embodiment under discussion, the value of "Vref" is chosen to be 30 which will smooth the switch between flashrates.

If, at block 550, "Vcount" exceeds "Vref", the input voltage is determined to be at least 20V and the "SKIP" function is deactivated at block 554. If "Vcount" is less than "Vref", the input voltage is determined to be less than 20V and the "SKIP" function is turned on at block 558. After the comparison, "Vcount" is reset to zero and the "FLASH" function is turned off at block 562.

Next, at block 566, the program determines whether the "SKIP" function is on. If so, "SKflash" is toggled at block 570. If not, "SKflash" is turned off at block 574. At block 578 (see FIG. 4D), the program again checks whether the "SKIP" function is on. If not, the program resets "RTCC" and "AFcount" to zero and turns off "SoscSD" at block 586. If "SKIP" is on, then block 582 ensures that block 586 will be executed only if the horn frequency is currently being swept upward.

The software continues at block 588 which determines whether the "SILENCE" function is off and the "CODE3" function is on. If not, the program skips the next function, which is maintenance of the Code 3 horn signal, and goes directly to block 618. If the conditions are met at test 588, the time since the last sync pulse, represented as "SYtimer", is checked at block 592. If it is equal to 0.5 seconds, then the variable "C3count", which keeps track of the sync pulses in each Code 3 signal cycle, is decremented at block 596.

Figure 7A:
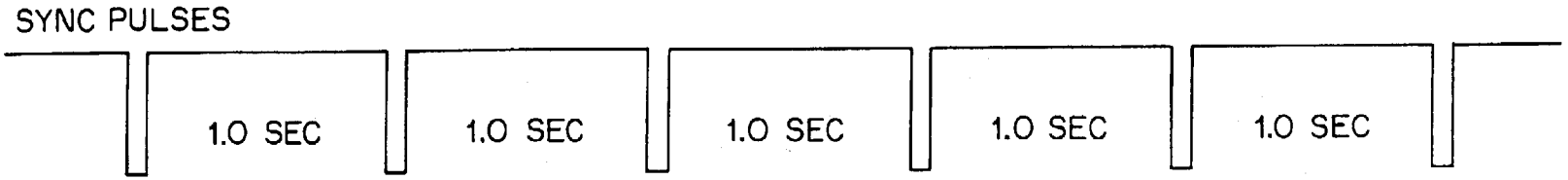
FIGS. 7A and 7B are diagrams showing the relationship between the system sync signal and the audio alarm signal of one embodiment of the present invention.
Figure 7B:
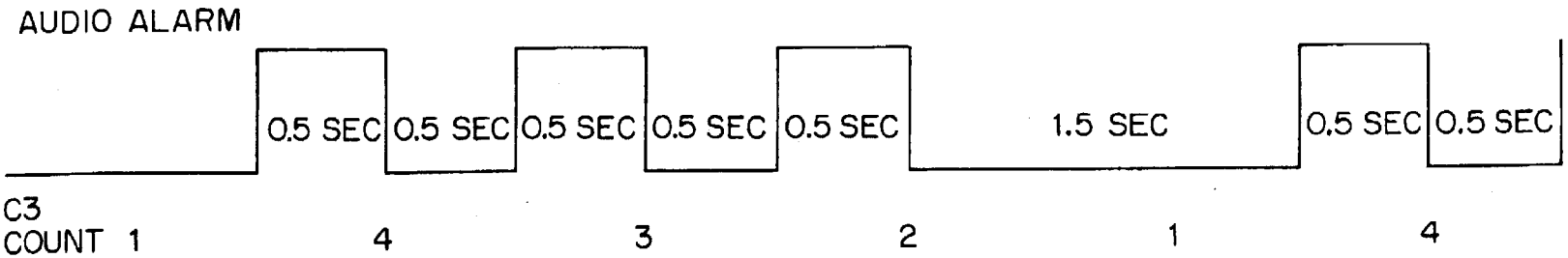

The relationship among "C3count", the sync pulses and the audio Code 3 horn signal is shown in FIGS. 7A and 7B. Each sync pulse triggers one-half second of silence followed by a one-half second horn blast, except when "C3count"=1. During that sync cycle, the horn blast is muted.

After decreasing "C3count", the program checks at block 600 to see if "C3count" is zero. If not, block 604, which sets "C3count" to 4, is skipped. Next, block 608 checks to see if "C3count" is greater than 1. If so, the "MUTE" function is turned off at block 612. If not, block 612 is skipped and the program moves to the next task.

At block 618 (see FIG. 4E), the program checks which mode the system is currently in, auto or sync. If it is in sync mode, "SYtimer" is increased at block 622. Block 626 compares "SYtimer" to the predetermined maximum time, "SYlimit", at which the system should be allowed to continue in the sync mode. If "SYtimer" is not less than "SYlimit", then there is a problem with the sync pulses and the mode is switched to auto at block 630. If not, the mode is left at sync and Control Program No. 2 is exited at block 634.

If the system is in auto mode, that is, the alarm units are operating independently of one another, "FRtimer", a variable which keeps track of the time since the last flash when in the auto mode, is decremented at block 638 and "C3count" is set to its initial value, "C3ini". At block 642, if "FRtimer" is not down to zero, Control Program No. 2 is exited. If "FRtimer" is zero, it is set to its initial value, "FRini", at block 646, and the "FLASH" function is turned on. Then, block 650 checks to see if the "SKIP" function is off. If not, block 654 checks to see if "SKflash" is on. If "SKflash" is on then control program No. 2 is exited. If not, the program flashes the strobe at block 658 by turning on SCR Q3. Returning to block 650, if the "SKIP" function is off, the program jumps to block 658 which flashes the strobe and exits.

Figure 5:
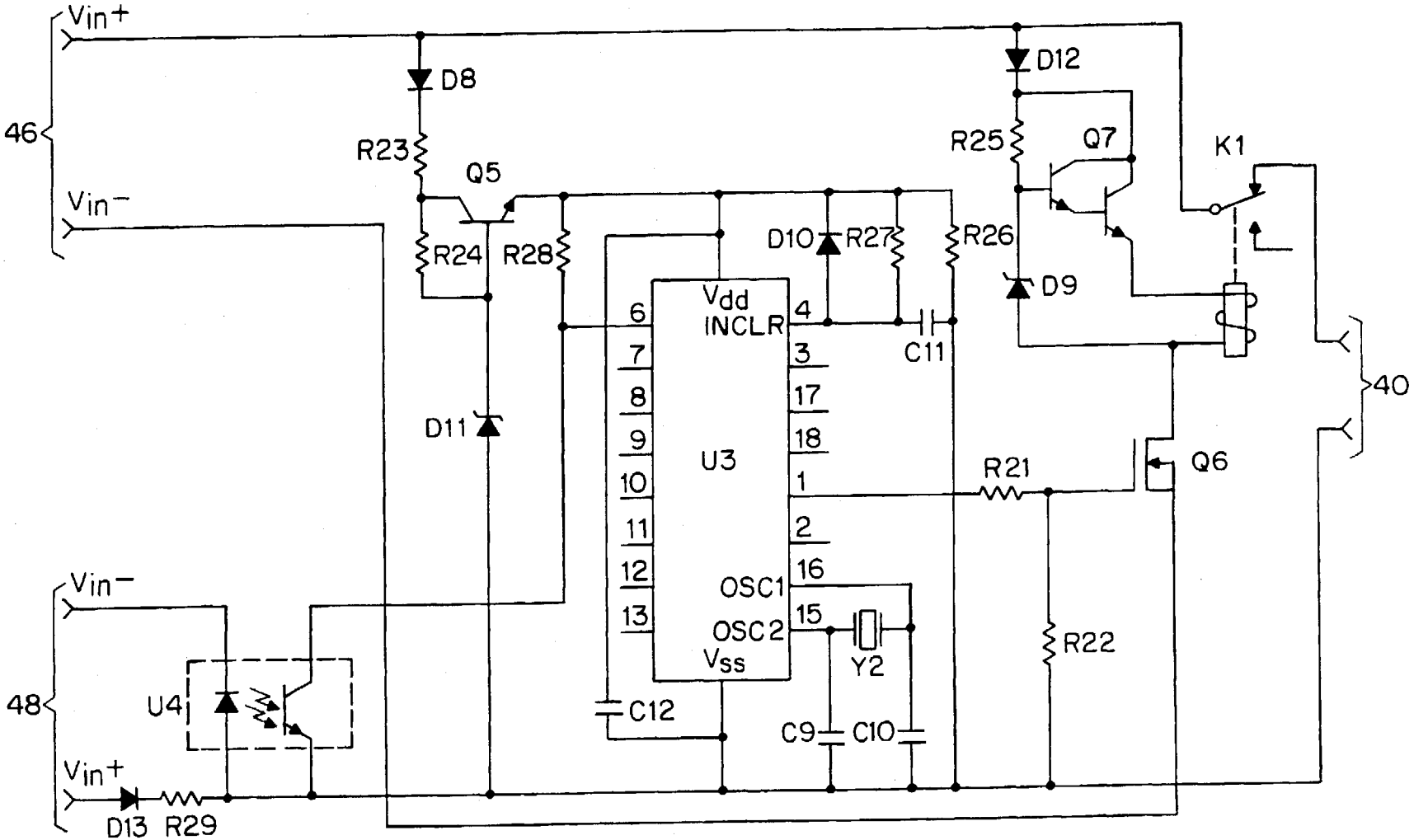
FIG. 5 is a circuit diagram of one embodiment of the interface control circuit of the present invention.

Turning now to the interface control circuit 44 of the invention, the preferred embodiment is shown in FIG. 5 connected across a D.C. voltage source which supplies a voltage Vin. The input voltage enters the interface via the primary loop 46 and normally passes through single pole single throw relay K1 and out of the interface to the system control loop 40. The D.C. voltage source is typically housed in the fire alarm control panel 25 and $V_{in}$ is nominally 24 volts. As discussed above, this voltage may have a wide range of values and the present invention can compensate for unexpected drops in voltage below what is necessary to operate the system at the flash rate of 1.02 Hz noted above.

The supply voltage $V_{in}$ is also applied through a diode D8, which typically has a voltage drop of 0.7 volts, to a regulator circuit which includes resistors R23 and R24, a transistor switch Q5 and Zener diode D11 connected as shown, with values chosen so as to provide a regulated 5.00 volts ±5% volts to the $V_{dd}$ input of microcontroller U3. Resistor R23 is between the cathode of diode D8 at one end and both the resistor R24 and the collector of switch Q5 at the other end. The other end of R24 is connected to the base of switch Q5. A capacitor C12 connected across the $V_{dd}$ and $V_{SS}$ terminals of U3 acts as a filter.

Resistors R26 and R27, capacitor C11 and diode D10 comprise a reset circuit for microcontroller U3. Resistor R27 is connected at one end to the emitter of switch Q5, the cathode of diode D10 and resistor R26, and at the other end to the "CLEAR" terminal 4 of microcontroller U3, the positive terminal of capacitor C11 and the anode of diode D10. The other end of resistor R26 is connected to the negative terminal of capacitor C11. Resistor R28 is connected between the emitter of switch Q5 at one end and terminal 6 of microcontroller U3 and optocoupler U4 at the other end, to provide a control input to microcontroller U3 for any one or more desired functions.

Oscillations at a frequency of 4 MHz are applied to terminals OSC1 and OSC2 of the microcontroller by a resonator circuit consisting of an oscillator Y2 and a pair of capacitors C9 and C10 connected between the first and second oscillator inputs, respectively.

In the preferred embodiment, the secondary loop 48 is used as an input for control signals. In the example under discussion, the control signals relate to the "SILENCE" feature which turns off the audio alarm in each of the alarm units while allowing the visual alarm to continue. The secondary loop 48 may also be used to provide an audio alarm control signal from the fire alarm control panel to the multiple alarm units. The latter function is implemented where the fire alarm system is already equipped with the capability to provide a desired alarm sequence, Code 3 in the preferred embodiment, and provides the necessary control signals to the system. In the case where the system does not have Code 3 capabilities, the interface unit can be programmed to provide the Code 3 control signals to the alarm units as will be described hereinbelow.

The secondary input loop 48 of the interface control circuit is connected across a D.C. source. An input from the control panel will be in the form of a power interrupt, or "drop out", which is detected by the microcontroller U3 at pin 6. Normally, voltage is applied at the secondary loop across the series connection of diode D13, resistor R29 and optocoupler U4. The LED of U4 turns on the transistor of U4 thereby causing current to flow across R28 and a voltage at pin 6 of microcontroller U3. Interruption of the D.C. source will turn off the transistor of U4 and pull pin 6 of U3 to $V_{dd}$ or 5V.

The direct connection from the primary loop input 46 to the control loop output 40 may be interrupted by activating the relay K1 which is accomplished by turning on switch Q6. Switch Q6 is turned on by an output of microcontroller U3 which is applied to the gate of switch Q6 via a voltage divider including a resistor R21 connected from output pin 1 of microcontroller U3 to the gate, and a resistor R22 connected from the gate electrode to the negative side of the power source.

When Q6 is closed, the potential at the output emitter of switch Q7, which preferably comprises a Darlington pair, is pulled to that of the negative side of the power source, causing Q7 to conduct. The voltage applied to the base electrode of one transistor of the Darlington pair Q7 is regulated by a resistor R25 and a Zener diode D9 in a series connection between the cathode of diode D12 and the end of the coil of relay K1 that is connected to switch Q6. When Q7 conducts, current flows through the coil of relay K1 and switches the relay from its normal position to the other contact. Actuation of the relay causes an interruption of the D.C. voltage normally supplied to the controlled alarm units.

The power drop outs can be used for any one of a number of control functions, "silence" being the example provided. Under the scheme discussed hereinabove, commands based on the position of sync/control pulses are sent to each alarm unit simultaneously. A more flexible alternative to pulse position coding is pulse train binary coding. One skilled in the art will appreciate that with a pulse train of, for example, eight pulse positions, several positions in the train can be assigned to the task of addressing commands to individual alarm units. One can envision circumstances where this would be advantageous, such as where one seeks to deactivate alarms on a particular floor while allowing the alarms to continue on others.

The interface control circuit 44 is capable of operating in three different modes. Which one of the three modes it will operate in depends on the capabilities of the existing system. The interface control circuit will operate in mode 1 in a system which is not equipped with Code 3 or silence capabilities. For mode 1 operation, the interface control circuit is installed with the primary loop, and the Code 3 signalling is performed by the interface control circuit as described earlier, not the fire alarm control panel. In mode 1, a silence feature is not available.

Mode 2 is used where the existing system has a silence feature, but not a Code 3 capability. In that case, the interface control circuit is installed with both a primary and secondary input loop, the secondary input loop being available for a silence signal from the control panel. As in mode 1, Code 3 is performed by the interface control circuit.

Finally, mode 3 is available for systems which already have Code 3 and silence function capabilities. Here, the interface control circuit is installed with both a primary and secondary input loop. The Code 3 control signal originates in the control panel as does the silence control signal.

By way of example, the interface control circuit under discussion and shown in FIG. 5, when energized from a 24 volt D.C. power source, may use the following parameters:

| ELEMENT | VALUE OR NUMBER |
|---|---|
| C9, C10 | CAP., 33pF |
| C11 | CAP., .47μF |
| C12 | CAP., 15μF, 16V |
| D8 | DIODE, 1N4007 |
| D9 | DIODE, 1N5236, 7.5V |
| D10 | DIODE, 1N914 |
| D11 | DIODE, 1N4626 |
| D12 | DIODE, 1N4007 |
| D13 | DIODE, 1N4007 |
| K1 | RELAY, DPST |
| Q5 | TRANSISTOR, 2N5550 |
| Q6 | TRANSISTOR, 1RF710 |
| Q7 | TRANSISTORS, T1P122 |
| R21 | RES., 220 |
| R22 | RES., 100K |
| R23 | RES., 330 |
| R24 | RES., 4.7K |
| R25 | RES., 4.7K, ½W |
| R26 | RES., 10K |
| R27 | RES., 39K |
| R28 | RES., 10K |
| R29 | RES., 2.7K, ½W |
| U3 | MICROCONTROLLER, PIC16C54 |
| U4 | OPTOCOUPLER, 4N35 |
| Y2 | CERAMIC RES., 4MHZ |

Figure 6:
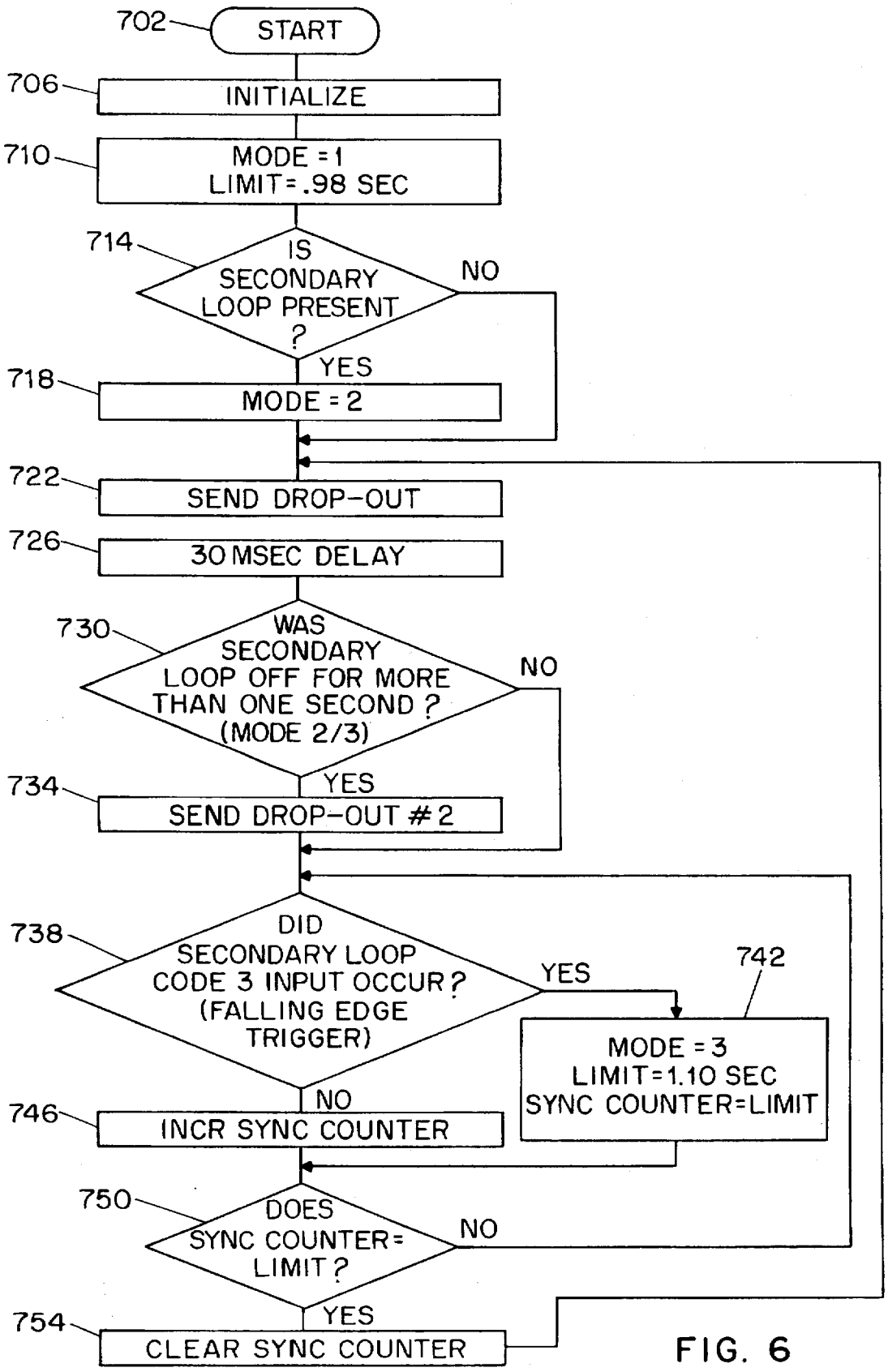
FIG. 6 illustrates the software routine of the microcontroller of the interface control circuit shown in FIG. 5.

The microcontroller U3 of the interface control circuit of FIG. 5 is responsible for closing switch Q6 and thus transmitting power drop outs which will be interpreted by the alarm units as described earlier. FIG. 6 illustrates the software routine of the microcontroller U3. At blocks 702 and 706, the program begins and is initialized. At block 710, mode 1 is assumed and the sync period limit is set to 0.98 seconds. Block 714 is an inquiry as to whether the secondary loop is present in the alarm system. If so, at block 718, the mode is set to mode 2. At blocks 722 and 726, a drop out of 30 msec duration which acts as the sync pulse is sent on the output control loop. Where the system is operating in either mode 2 or 3, the program inquires at block 730 as to whether there has been an interrupt in power of more than one second to the secondary loop, which would indicate a silence signal from the control panel. If so, at block 734 a second "drop out" is sent to the alarm units almost immediately. Although not shown in FIG. 6, one skilled in the art will appreciate that the silence feature can be similarly deactivated by another input of significant duration to the secondary loop after which a dropout in the third pulse position, for example, is sent to the interface control circuit.

Next, at block 738, the program looks for an input indicative of Code 3 from the control panel on the secondary loop. If one is detected, block 742 sets the mode number to 3, sets the sync period limit to 1.10 seconds and sets the sync counter to the limit, 1.10 seconds. This slight increase in the sync period ensures proper Code 3 operation when Code 3 signals are originating from the control panel 25 rather than the interface control circuit 44. If the Code 3 input is not detected, the sync counter is incremented at block 746. Next, at block 750, the program looks at whether the sync counter has reached the set limit. If so, the program clears the sync counter at block 754 and loops back to block 722, thereby sending a drop out. If the limit has not been reached, the program loops back to block 738.

While the invention has been described herein by reference to preferred embodiments thereof, it will be understood that such embodiments are susceptible of variation and modification without departing from the inventive concepts disclosed. For example, in the appended claims, the means for performing the different functions may be only a single microprocessor within an alarm unit or the interface control circuit, as described above, or several microprocessors or functional circuits may be employed. All such variations and modifications, therefore, are intended to be included within the spirit and scope of the appended claims.

I claim:

1. An alarm unit for use in an alarm system having a power source for providing a power signal to the alarm unit over a two-conductor power distribution line and an alarm control circuit for varying the power signal to the alarm unit in one or more predetermined patterns to control alarm unit operation, the alarm unit comprising:

means connectable to said two-conductor power distribution line for receiving said power signal as the sole source of power for said alarm unit;

means for generating an audible alarm signal; and means for detecting predetermined-pattern variations in said power signal and, in response thereto, for controlling the operation of said audible alarm generating means to generate an audible alarm signal without loss of power to said alarm unit.

2. The alarm unit of claim 1, wherein said detecting and controlling means comprises means for controlling the operation of said audible alarm signal generating means to produce a Code 3 signal in response to the detection of a first predetermined-pattern variation in said power signal.

3. The alarm unit of claim 1, wherein said detecting and controlling means comprises means for silencing the audible alarm signal generating means upon detection of a second predetermined-pattern variation in said power signal.

4. The alarm unit of claim 3, wherein said detecting and controlling means further comprises means for reactivating the audible alarm signal generating means, following a silencing of the audible alarm signal, upon detection of a third predetermined-pattern variation in said power signal.

5. The alarm unit of claim 1, wherein said predetermined pattern variations in said power signal comprise dropouts in the power signal.

6. The alarm unit of claim 1, wherein said detecting and controlling means comprises a programmed microcontroller.

7. The alarm unit of claim 1, wherein the audio alarm signal comprises a bell tone.

8. The alarm unit of claim 1, wherein the audio alarm signal comprises a horn sound.

9. The alarm unit of claim 1, wherein the audio alarm signal comprises a chime sound.

10. The alarm unit of claim 1, wherein the audio alarm signal comprises a slow whoop sound.

11. The alarm unit of claim 1, wherein the audio alarm signal comprises a prerecorded voice message.

* * * * *

UNITED STATES PATENT AND TRADEMARK OFFICE

CERTIFICATE OF CORRECTION

PATENT NO. : 5,751,210

DATED : May 12, 1998

INVENTOR(S) : Joseph Kosich

It is certified that error appears in the above-identified patent and that said Letters Patent is hereby corrected as shown below:

On the Title page, and col. 1, lines 1-2

Item [54] "SYNCHRONIZED VIDEO/AUDIO ALARM SYSTEM", should read -- AUDIBLE ALARM UNIT --;

Col. 7, line 10, "FIG. 4A and 4B" should read -- FIGS. 4A and 4B -- ;

Col. 8, line 65, "FIG. 4C, 4D and 4E" should read — FIGS. 4C, 4D and 4E--.

Signed and Sealed this

Twenty-ninth Day of August, 2000

*Attest:*

*Attesting Officer*

Q. TODD DICKINSON

*Director of Patents and Trademarks*